US007871253B2

(12) United States Patent
Kreidl et al.

(10) Patent No.: US 7,871,253 B2
(45) Date of Patent: Jan. 18, 2011

(54) STATOR CLAMPING DEVICE FOR ECCENTRIC SCREW PUMP

(75) Inventors: Johann Kreidl, Waldkraiburg (DE); Guenter Fischbach, Waldkraiburg (DE); Hisham Kamal, Waldkraiburg (DE); Franz Kneidl, Waldkraiburg (DE); Helmuth Weber, Simbach am Inn (DE); Markus Rosam, Aschau am Inn (DE); Tanja Donislreiter, Oberneukirchen (DE); Reinhard Denk, Muehldorf (DE)

(73) Assignee: Netzsch-Mohnopumpen GmbH (DE)

( * ) Notice: Subject to any disclaimer, the term of this patent is extended or adjusted under 35 U.S.C. 154(b) by 273 days.

(21) Appl. No.: 11/857,693

(22) Filed: Sep. 19, 2007

(65) Prior Publication Data

US 2008/0008611 A1 Jan. 10, 2008

Related U.S. Application Data

(63) Continuation of application No. PCT/DE2006/000471, filed on Mar. 17, 2006.

(30) Foreign Application Priority Data

Mar. 21, 2005 (DE) ..... 10 2005 013 466

(51) Int. Cl.
*F01C 1/10* (2006.01)
*F01C 5/00* (2006.01)
*F03C 2/00* (2006.01)

(52) U.S. Cl. ..... 418/48; 418/153; 417/313

(58) Field of Classification Search ..... 418/48, 418/152, 153; 417/313, 430, 900
See application file for complete search history.

(56) References Cited

U.S. PATENT DOCUMENTS

| | | | | |
|---|---|---|---|---|
| 3,857,654 | A * | 12/1974 | Streicher | 418/48 |
| 4,818,197 | A * | 4/1989 | Mueller | 418/48 |
| 5,122,038 | A * | 6/1992 | Malkoski | 417/313 |
| 6,923,273 | B2 * | 8/2005 | Terry et al. | 175/45 |
| 7,010,201 | B2 * | 3/2006 | Risch | 385/100 |

FOREIGN PATENT DOCUMENTS

| | | | |
|---|---|---|---|
| DE | 2027993 | | 12/1971 |
| DE | 2425055 | | 12/1975 |
| DE | 4104282 | | 8/1991 |
| DE | 4116697 | | 3/1992 |
| DE | 9116377 | | 9/1992 |
| DE | 29503838 | | 4/1995 |
| DE | 19855898 | | 6/2000 |
| FR | 1284388 | A * | 9/1962 |
| JP | 06249158 | A * | 9/1994 |
| JP | 2005344585 | | 12/2005 |

OTHER PUBLICATIONS

International Search Report, Jul. 6, 2006, 2 pages.

* cited by examiner

*Primary Examiner*—Theresa Trieu
(74) *Attorney, Agent, or Firm*—St. Onge Steward Johnston & Reens LLC

(57) ABSTRACT

The invention relates to a clamping device which clamps the pump stator with the pump housing and an additional pump end part. The width of the clamping bars is at least 20% of the cross section of the pump stator in order to stabilise the clamping device and the simplify handling. All parts which are required to clamp the pump end part remain on the clamping bars.

14 Claims, 4 Drawing Sheets

STATOR CLAMPING DEVICE FOR ECCENTRIC SCREW PUMP

CROSS-REFERENCE TO RELATED APPLICATIONS

The present application is a continuation of pending International patent application PCT/DE2006/000471 filed on Mar. 17, 2006 which designates the United States and claims priority from German patent application 10 2005 013 466.1 filed on Mar. 21, 2005, the content of which is incorporated herein by reference.

FIELD OF THE INVENTION

The invention relates to a stator clamping device for eccentric screw pumps with a pump stator disposed between a pump housing part and a pump end part, wherein at at least two elements clamping these parts together are disposed between the pump housing and the pump end part.

BACKGROUND OF THE INVENTION

DE 41 16 697 C1 shows an eccentric screw pump wherein a pump stator is embedded between two housing parts. Both housing parts have a connection piece which lies adjacent to the inside of the stator casing. The distance between the two housing parts is limited by stay bolts. The stay bolts are connected to the one housing part by a thread and to the other housing part by a clamping device. For this purpose, the clamping device comprises a threaded shoulder, which at its outer end carries a slackly placed threaded nut, which connects the stay bolt body to the flange clip.

There is known from DE 20 27 993 A1 an eccentric screw pump, whose stator lining projects on both sides beyond the stator casing. The pump housing and the pressure flange lie adjacent both to the lining and to the stator casing. A spacer bolt is shown for securing the connection between the pressure flange and the pump housing. This spacer bolt is provided on both sides with threaded shoulders, which project axially beyond the foot shoulders. The spacer bolts lie adjacent to the insides of the feet and are clamped to the latter by means of threaded nuts on the threaded shoulders.

DE 24 25 055 shows a stator support, wherein the stator is connected to housing parts adjacent on both sides. In this example of embodiment, the connection comprises three screws offset in each case through 120° and with a uniform cross-section over their whole length. The screws are clamped to the housing parts by means of threaded nuts sitting slackly on their end.

A mortar pump with a funnel, a feeding screw and a screw pump following the latter is shown in DE 41 04 282 A1. The connection between the screw pump and the pump housing takes place by means of quick-action tension jacks. For this purpose, there is provided at the delivery end of the screw pump and at the entrance side of the housing of the feeding screw in each case a plate which has two projections or recesses, which are provided as a support for the quick-action tension jack.

A clamping device for a pump, which sits between a connecting piece and a storage container, emerges from DE 295 03 838 U1. Here, two clamping elements are connected in each case at the opposite side of the pump to a flange of the storage container and a flange on the connecting piece. Each flange has two contact points with the clamping elements.

DE 91 16 377 U1 also shows a clamping device for screw pumps. Here, use is made of thin threaded rods, which clamp the flanges together in front of and behind the pump.

Proceeding from this prior art, the problem of the invention consists in increasing the ease of assembly and maintenance of the pump in combination with the stability of the connection between the stator and its connection parts.

SUMMARY OF THE INVENTION

According to the invention, this problem is solved by the features of claim 1. Developments of the invention are the subject-matter of the sub-claims.

The inventive clamping device for pumps relates in particular to the connection of the stator to its adjacent pump end parts, which can for example comprise a pump housing part and a pump end part such as a pressure flange. Since leaks and non-uniform pressure on the sealing parts between the stator and the adjacent pump end parts should be avoided, the clamping device according to the invention has clamping bars disposed laterally with respect to the stator, the width of said clamping bars amounting to at least 20% of the stator cross-section. As a result of this increase in the width of the clamping means, there is also an enlargement of the area over which pressure is transmitted to the contact surfaces of the stator with the adjacent surfaces of the pump end parts. The width of the clamping bars can amount to 20% to 120% of the diameter of the stator. As a result of the enlargement of the clamping bar width, there is an enlargement of the active area with which, amongst other things, pressure is exerted on the stator ends. With an equal or lower point-like pressure, a homogenisation of the pressure over the whole extent of the stator end faces is thus produced. The elastomer region projecting at the stator ends is thus uniformly compressed and loaded.

In order to reduce the assembly cost, all the parts that are required for the clamping of the stator are connected to the clamping bars or fixed to the latter. The clamping bars are disposed laterally parallel to the longitudinal axis of the pump. The longitudinal axes of the clamping bars and the stator run horizontally.

The design of the clamping bars can or is suitably adapted to the overall height of the pump, or more precisely to its operating pressure.

The width of the clamping bar and also the nature of the connection of the clamping bar to the respective pump end parts is selected according to the delivery pressure that the pump generates.

The clamping bars can have identical or also different connection elements at the two ends. In order to simplify the assembly, the clamping bars can have a form-fit connection at their one longitudinal end and a friction-locked connection at their other end. The pump end part connected thereto is also formed depending on the design of this connection.

According to one embodiment of the clamping bars, at least one end of the clamping bar is bent off at an angle and the angle thus arising forms a form-fit connection with an adjacent pump end part. The pump end part entering into a form-fit connection with the clamping bar can also have grooves, fluting, noses, holes, slots or similarly acting elevations or depressions which engage into corresponding counterparts on the pump end part.

The ends of the clamping bar run at an angle of 30° to 120°, preferably 90°, to the clamping bar itself. If the bent-off end part of the clamping bar itself forms the form-fit connection, the angle is not greater than 90°, unless the end of the clamping bar is bent off at an angle two or more times.

In a further embodiment according to the invention, the clamping bar has one or more perforations at at least one end running axis-parallel to the pump longitudinal axis, into which perforations projections of the pump end parts engage in this region. The clamping bar can thus be connected at least at one of the two ends to the pump end parts by a slip-on procedure at right angles to the pump longitudinal axis.

A further embodiment of the clamping bar concerns the disposal of a friction-locked connection possibility at at least one end. The friction-locked connection proceeds either from the clamping bar onto adjacent pump end parts or from pump end parts onto the clamping bar.

If the friction-locked connection proceeds from the clamping bar, the clamping bar is, for example, bent off at an angle in this region and accommodates one or more clamping screws. This/these clamping screw/s is/are moved in a thread of the clamping bar and thus presses/press onto a surface of a pump end part, e.g. a pressure flange. As a result of this pressure of the screw, the clamping bar transmits a tensile stress to a further pump end part and thus clamps the stator between two pump end parts.

A further possibility of clamping the stator with two adjacent pump end parts exists through the application of a tensile stress on the clamping bar. For this purpose, the clamping bar ends at least at one of its longitudinal ends before a support of the adjacent pump end part. By means of a screw, which engages into a thread in the clamping bar, but which is merely held on the adjacent pump end part, the screw generates a tensile stress depending on how often it is turned. This tensile stress is in turn transmitted by the clamping bar to the second pump end part adjacent to the stator, so that the stator is clamped between the pump housing and a pump end part, in particular a pump flange.

Depending on how wide the clamping bars are designed, in order thereby to exert pressure on the adjacent pump parts, the more contact areas can be provided between the clamping bars and the adjacent pump parts. In the case of high pressures and wide clamping bars, the clamping or tensile forces can be transmitted via several transmission points or areas. At the narrow end sides of the clamping bars, up to four pressure transmission points or areas can thus be provided in each case. The transmission points can then be disposed both on a straight line and also on a circle-segment-shaped section.

If the tensile or clamping force is brought about by elements such as tension or clamping screws or spring-loaded pins which rest on shoulders or on the pump end part adjacent to the stator, these shoulders can have slots which enable the lateral removal of the clamping bar without the elements having to be removed from the clamping bar.

According to a further embodiment of the invention, it is possible by using quick-action clamping devices to remove the clamping bars from the pump without the use of a tool and to replace the stator or to change its position.

The clamping bar can, in addition to the clamping function that it performs, also assume information and control functions. For this purpose, visual displays or control elements can be put onto or into the visible lateral surface. The visual displays range from the type plate through digital and numeric displays. Pressure values, operating hours, speeds, temperatures, product values and suchlike can for example be displayed here by the integration of suitable measuring instruments or graphic images. If it concerns individual pumps or pumps from an interconnected system arrangement, the integration of switching elements for the speed control, start-up behaviour, metering of additives would be possible.

In order to protect the devices, the clamping bar should also be bent at an angle at its longitudinal sides, in order to form a hollow space towards the stator in which the sensitive electrical/electronic parts can be disposed.

Examples of embodiment of the clamping device according to the invention can be found in the following drawings. In the figures:

DETAILED DESCRIPTION OF THE INVENTION

Figure 1:
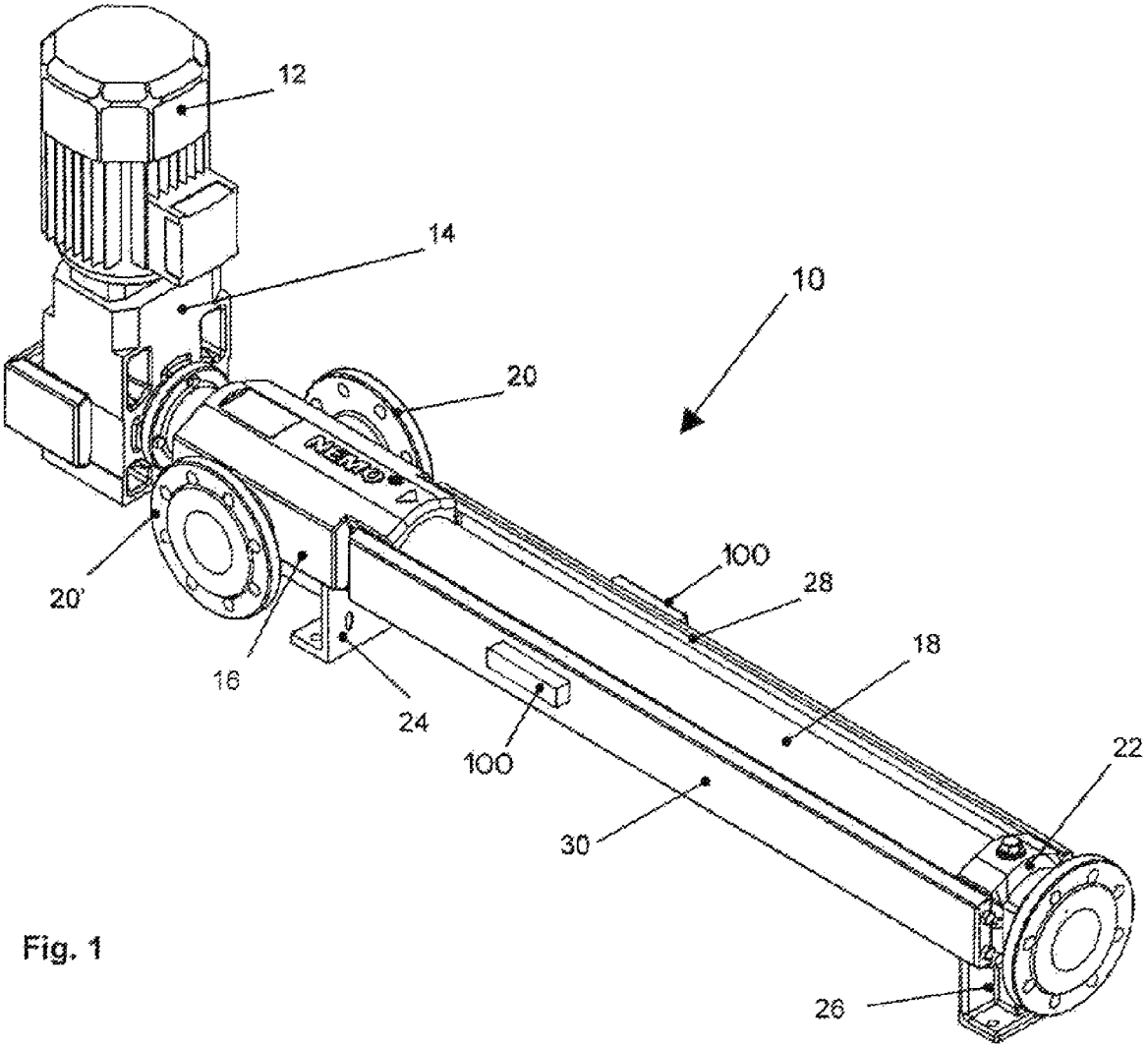
FIG. 1 shows an overall view of a pump.

FIG. 1 shows a pump 10, an eccentric screw pump, according to the invention. The pump has a drive 12, which is connected by the interposition of a gear 14 or intermediate gear to an intermediate shaft and thus also to a rotor (not shown). Pump housing 16 is disposed between the gear housing and stator 18.

Two flanges 20, 20' lying opposite are attached at the sides of pump housing 16, via which flanges product arrives into pump housing 16. Provided in the region of pump housing 16 and in the region of pump end part 22, a housing 16 and in the region of the pressure flange are supports 24, 26 on which the pump stands. Located between pump housing 16 and pump end part 22 is stator 18, which is surrounded by clamping bars 28, 30. Clamping bars 28, 28', 28", 30, 30', 30" are connected by form-fit or frictionally locked elements to pump housing 16 and pump end part 22. Pump end part 22 is configured for example as a flange, which has a pipe connection.

Figure 2:
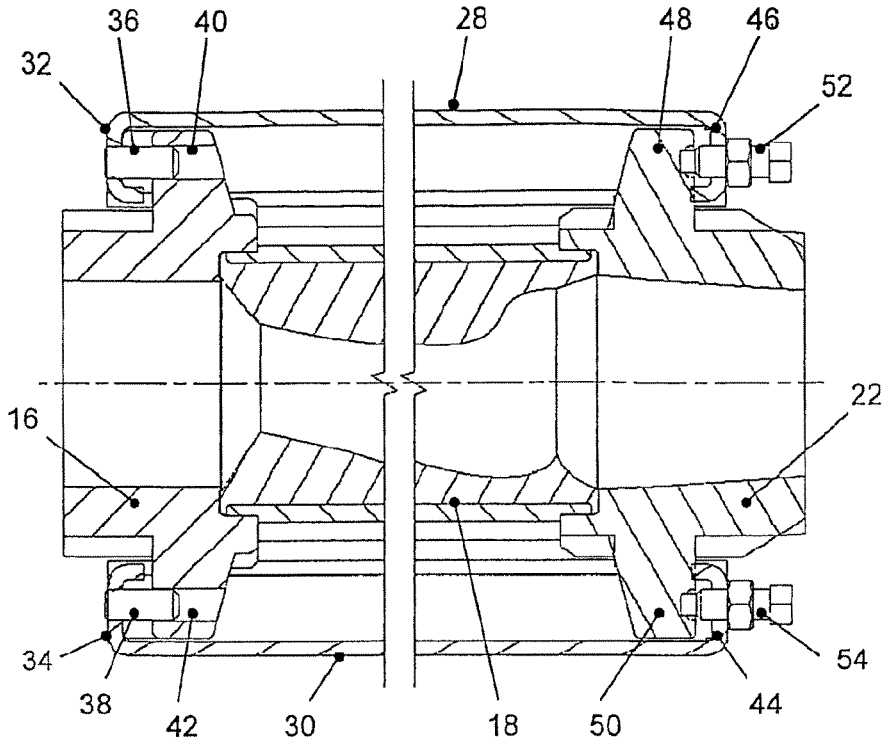
FIG. 2 shows a horizontal partial section of a pump with clamping bar with compressive stress.

FIG. 2 shows one of a large number of possibilities as to how clamping bars 28, 30 are connected to pump housing 16 and pump end part 22. In this example of embodiment, the left-hand ends of clamping bars 28, 30 are in a form-fit connection with the pump housing. For this purpose, the ends of clamping bars 28, 30 are bent off through an angle of 90°. Provided on bent-off legs 32, 34 of clamping bars 28, 30 are one or more bolts 36, 38, which engage(s) in a hole or holes 40, 42. The other end of clamping bars 28, 30 is also bent off at an angle of 90°. Legs 44, 46 engage around one or more shoulders 48, 50 of pump end part 22. Threads are introduced into the legs. Screws 52, 54 are supported in the threads and thus press against shoulders 48, 50, as a result of which clamping bars 28, 30 produce a connection between pump housing 16 and pump end part 22 and thus fix stator 18 between them. If it is necessary to change or rotate the stator, the screws are slackened to an extent such that clamping bars 28, 30 can be removed. Both bolts 36, 38 and screws 52, 54 and the lock-nuts remain on clamping bars 28, 30.

Figure 3:
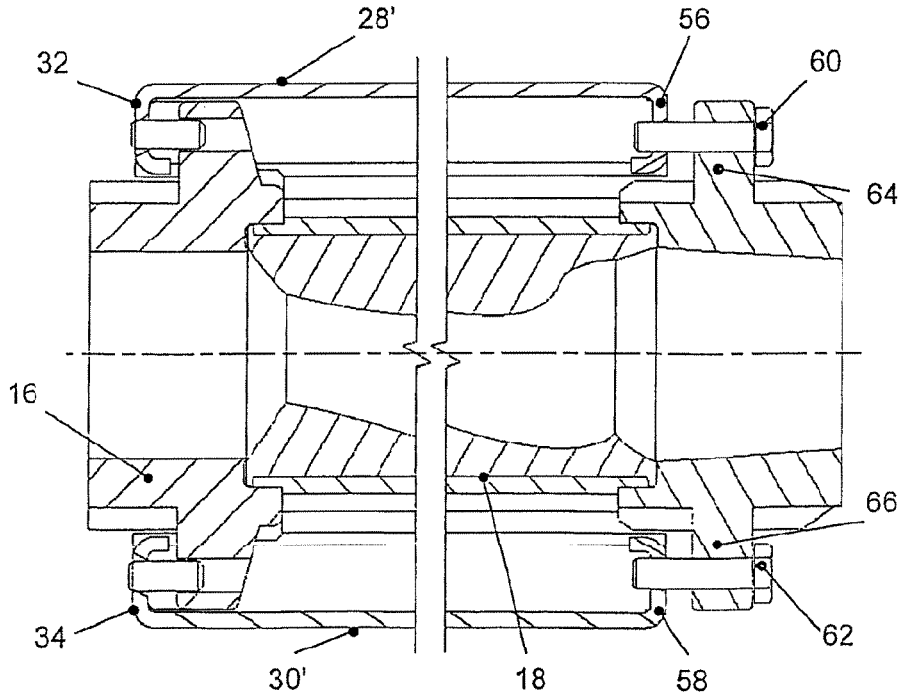
FIG. 3 shows a horizontal partial section of a pump with clamping bar with tensile stress.

A further connection possibility between pump housing 16 and pump end part 22 can be seen from FIG. 3. The embodiment of the left-hand side of clamping bar 28", 30" corresponds to that of FIG. 2, i.e. a form-fit variant. The right-hand side of clamping bar 28", 30" is connected to a pump end part 22 by the application of a tensile stress. For this purpose, bent-off legs 56, 58 are provided with a thread, into which tension screws 60, 62 engage. When clamping bars 28', 30' are assembled or dismantled, the tension screws therefore merely have to be tightened up or slackened. The tension screws can be withdrawn from the shoulder or shoulders through radial slots (not shown) open to the exterior, without the tension screws having to be detached from clamping bar 28", 30". Instead of individual lateral shoulders 64, 66, an annular collar can also be provided on pump housing 16 or a pump end part 22.

Figure 4:
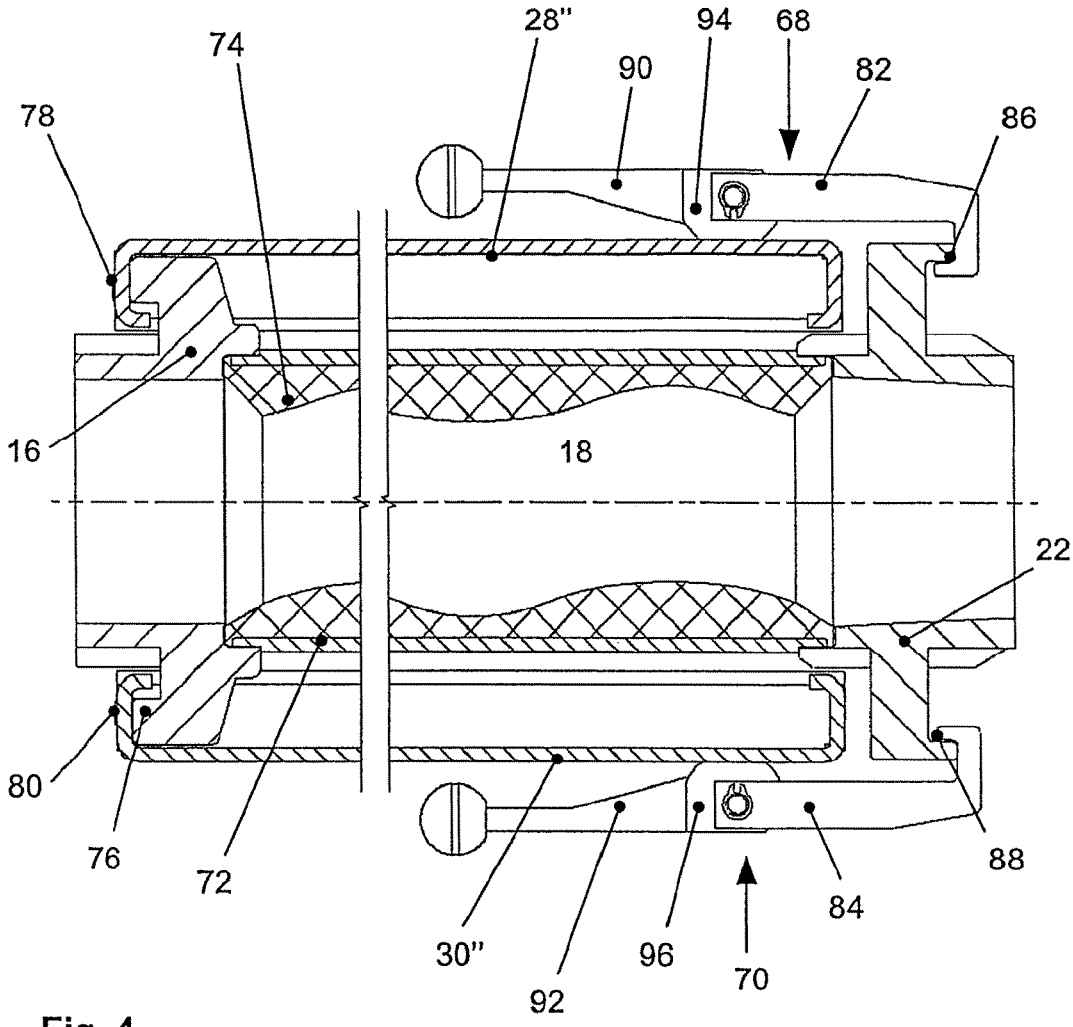
FIG. 4 shows a horizontal partial section of a pump with clamping bar with a quick-action clamping device.

According to the example of embodiment according to FIG. 4, the use of screws is completely dispensed with. Here, two quick-action clamping devices 68, 70 take over the clamping of stator 18 between pump housing 16 and a pump end part 22. On account of the clamping, pressure arises on elastomer stator lining 74 projecting axially beyond stator casing 72, as a result of which the stator is sealed with respect to pump housing 16 and pump end part 22. Clamping bars 28', 30' enter in this example of embodiment into a direct form-fit connection with pump housing 16 and, for this purpose, are bent off at an angle at least once. In this special embodiment, clamping bar 28", 30" engages around a shoulder 76 on pump housing 16. In order to stabilise the position of clamping bar 28", 30" during the fitting of pump end part 22, its one end engages behind shoulder 76. In addition to this, the leg bent off through an angle of 90° can have openings into which projections 80 of shoulder 76 engage.

The second end of clamping bars 28", 30" remains without direct contact with pump end part 22. This contact is produced by means of a hook 82, 84, which engages behind a projection 86, 88 on pump end part 22. Hooks 82, 84 of the quick-action clamping devices are connected to swivelling levers 90, 92. Each lever 90, 92, which is connected to clamping bar 28", 30", reduces or increases, during a movement directed in or against the clockwise direction, the distance to pump end part 22 and thus clamps or releases the connection of stator 18 with its adjacent components. The extent of the distance by which the hook can be shortened or lengthened with respect to clamping bar 28", 30" is determined by cam 94, 96. In order to facilitate the assembly, cam 94, 96 has three non-rounded surfaces each offset through approx. 90°. The cam thus assumes three stable positions. The cam assumes the positions when the clamping devices are opened and closed and when the stator is centered in the direction of the pump housing and with respect to the pump end part. In principle, quick-action clamping is of course also possible if the length of the clamping bar itself is variable by means of a quick-action tension jack, for which purpose the clamping bar itself comprises several parts.

Figure 5:
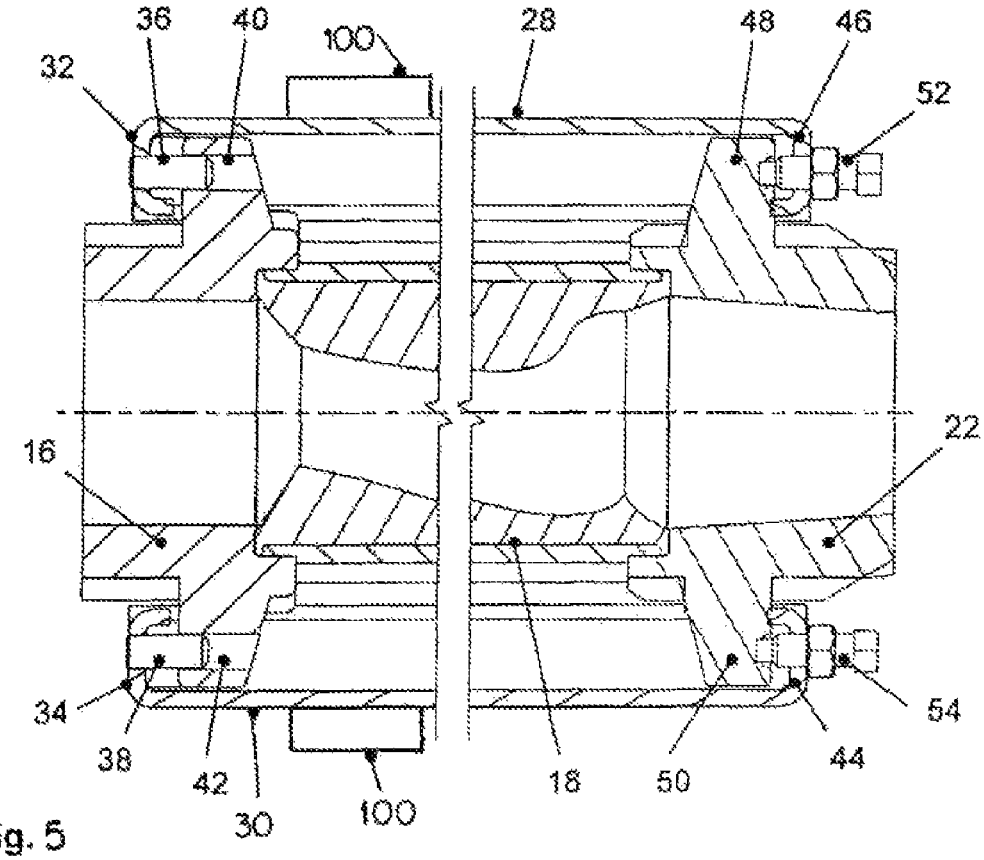
FIG. 5 shows a horizontal partial section of a pump having optical or electronic display fields and actuating elements.

The clamping device may be characterized in that an angle of the clamping bars (28, 28', 28", 30, 30', 30") has a bolt (36, 38), a peg (36, 38) or an anchor (36, 38) and thus forms a form-fit connection with the pump housing (16) or the pump end part (22). The clamping device may also be characterized in that at least one clamping bar (28, 28', 28", 30, 30', 30") has optical or electronic display fields (100). The clamping device may be characterized in that at least one clamping bar (28, 28', 28", 30, 30', 30") contains actuating elements (100). The optical or electronic display fields and actuating elements (100) are shown in FIG. 5. FIG. 5 shows the optical or electronic display fields and actuating elements (100) as a box used to represent these elements.

What is claimed is:

1. A stator clamping device for eccentric screw pumps comprising:

a pump stator disposed between a pump housing and a pump end part, at least two elements for clamping the pump housing to the pump end part, said at least two elements disposed between the pump housing and the pump end part, and said at least two elements having clamping bars disposed laterally with respect to the stator, the width of the clamping bars being at least 20% of the diameter of the stator, and at least two pressure transmission points disposed at least one narrow end side of the clamping bars, wherein the clamping bars having legs that are bent off through 90° at least at one end, and wherein the bent-off legs of the clamping bars are connected via friction-locked elements to the pump housing, the pump end part, or both the pump housing and the pump end part.

2. The clamping device of claim 1, characterized in that the pressure transmission points are arranged on a straight line or a circle-segment-shaped section on the end sides of the clamping bars.

3. The clamping device of claim 1, characterized in that an angle of the clamping bars has a bolt, a peg or an anchor and thus forms a form-fit connection with the pump housing or the pump end part.

4. The clamping device of claim 1, characterized in that the clamping bars have at least at one end an opening into each a counterpart projecting from the pump housing or the pump end part engages.

5. The clamping device of claim 1, characterized in that the clamping bars have at least at one end screw-like clamping elements.

6. The clamping device of claim 5, characterized in that the clamping elements comprise screws, threaded rods or nuts.

7. The clamping device of claim 1, characterized in that the clamping bars have at least one quick-action clamping device.

8. The clamping device of claim 1, characterized in that the clamping bars are bent off at an angle at their longitudinal sides.

9. The clamping device of claim 8, characterized in that the clamping bars and the stator define a hollow space.

10. The clamping device of claim 1, characterized in that at least one clamping bar has optical or electronic display fields.

11. The clamping device of claim 1, characterized in that at least one clamping bar contains actuating elements.

12. The clamping device of claim 1 characterized in that the ends of the clamping bars are connected via form-fit elements to the pump housing, the pump end part, or both the pump housing and the pump end part.

13. The clamping device of claim 1, characterized in that the clamping bars are disposed laterally parallel to the longitudinal axis of the pump.

14. The clamping device of claim 1, characterized in that the clamping bars have one or more perforations at least one end running axis-parallel to the pump longitudinal axis.

* * * * *